United States Patent [19]

Moraru

[11] 4,042,237

[45] Aug. 16, 1977

[54] TENNIS TRAINER

[76] Inventor: Cornel Moraru, 19 W. 55 St. PH-1, New York, N.Y. 10019

[21] Appl. No.: 699,603

[22] Filed: June 24, 1976

[51] Int. Cl.[2] ..... A63B 69/38

[52] U.S. Cl. ..... 273/29 A

[58] Field of Search ..... 273/29 A, 29 R, 26 R, 273/95 A, 58 C, 176 FB, 177 A, 177 B, 181 J, 182 R, 35 R, 184 B, 185 D, 196, 197 R, 197 A, 199 A, 200 B

[56] References Cited

U.S. PATENT DOCUMENTS

| | | | |
|---|---|---|---|
| 805,543 | 11/1905 | Hayes | 272/76 |
| 2,695,175 | 11/1954 | Trapp | 273/184 B |
| 3,937,464 | 2/1976 | Zalewski | 273/26 R |

FOREIGN PATENT DOCUMENTS

| | | | |
|---|---|---|---|
| 2,239,263 | 2/1975 | France | 273/29 A |

*Primary Examiner*—Anton O. Oechsle
*Assistant Examiner*—T. Brown
*Attorney, Agent, or Firm*—Bierman & Bierman

[57] ABSTRACT

A tennis trainer is provided in which a plurality of telescoping shafts are mounted to a support surface. One of the shafts carries a tennis ball and telescopes into the other shafts. The means for mounting the telescoping shafts comprises means for permitting the shafts to travel vertically over a selected angle so that when the tennis ball is hit, the trajectory traversed by the tennis ball simulates live action. Means for returning the telescoping shafts to their original position is also provided.

21 Claims, 10 Drawing Figures

TENNIS TRAINER

This invention relates to tennis training devices and more particularly to a tennis trainer which dynamically simulates live action.

A plethora of tennis training devices exist. With the exception of a conventional rebound net, prior art tennis trainers are generally insufficient simulators of actual playing conditions. Tennis trainers consisting of an arm pivotably mounted to a fixed support have been employed. When the ball is struck by a racket, the arm pivots and then returns to its original position. The trajectory of the tennis ball as it moves away from the racket is quite foreign to the trajectory of the ball during actual play. Any stroke, whether good or bad, will cause the arm to pivot, thus making it difficult if not impossible for the user to know whether the stroke was good or bad. This type of trainer does not properly train the user's stroke.

Other types of prior art devices employ a rotatable arm to which the tennis ball is mounted. When the ball is hit, the arm rotates about its support. Other types of trainers utilize stationary tennis balls. Neither of these structures provide simulated real play conditions and thus have limited usefulness.

In accordance with the present invention, a plurality of telescoping shafts are provided. One of the shafts is mounted on a support and the other shafts telescope into the support mounted shaft. A tennis ball is mounted on the end of the shaft furthest from the support. When the tennis ball is struck, the shafts telescope towards the support. Return means are provided to return the shafts towards their fully extended position under selected conditions. For best results, the selected conditions simulate actual play, thus helping to train the user's form and to regulate the power of the stroke.

With the telescoping shaft assembly, the tennis ball, when struck, moves directly away from the racket in substantially the same manner obtained during actual play. To further simulate actual play, the support to which the shafts are mounted can be provided with a limited degree of vertical movement to permit the shafts to pivot with respect to the support to simulate the trajectory one obtains during actual play. Horizontal movement of the shafts can also be provided, if desired, to help prevent damage to the assembly in the event the tennis ball is badly mis-hit.

The tennis trainer of the instant invention is suitable for indoor use. The telescoping shafts can be mounted to a bar which in turn can be mounted in a door frame. Alternatively, a mounting unit can be affixed to a door frame or other wall surface. In either case, best results are obtained when the mount is provided with a limited degree of rotational or angular movement to permit the tennis ball to assume a trajectory simulating real play condition.

Referring now to the drawings in which like numerals refer to like parts:

Figure 2:
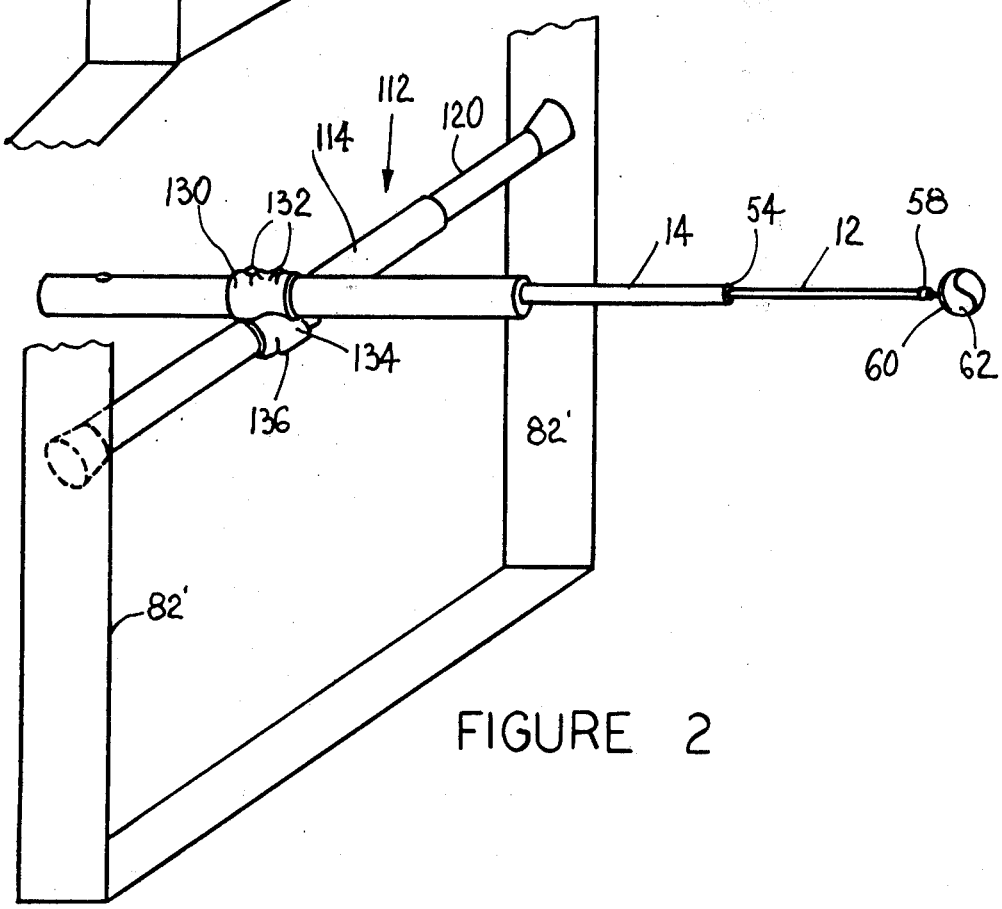
FIG. 2 is an isometric view of the tennis trainer of FIG. 1 showing a second embodiment of a mounting unit.
Figure 5A:
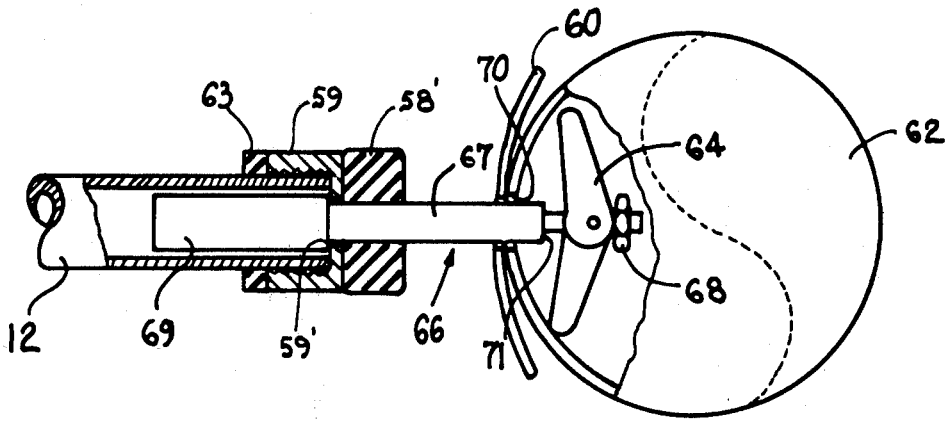
Figure 5B:
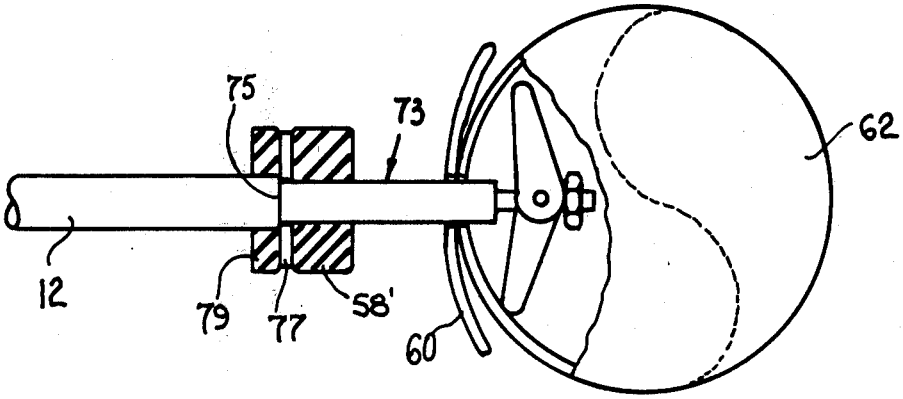
Figure 6:
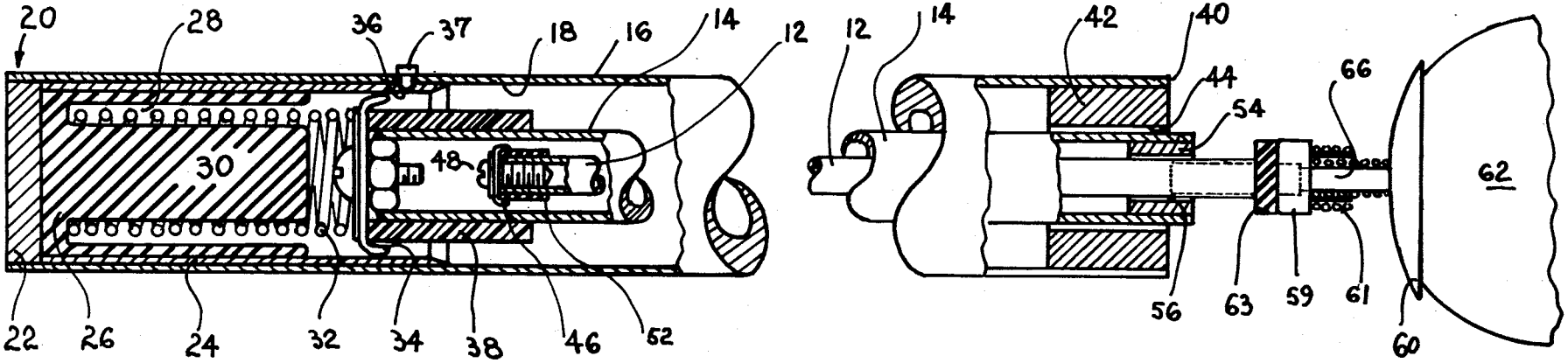
Figure 7:
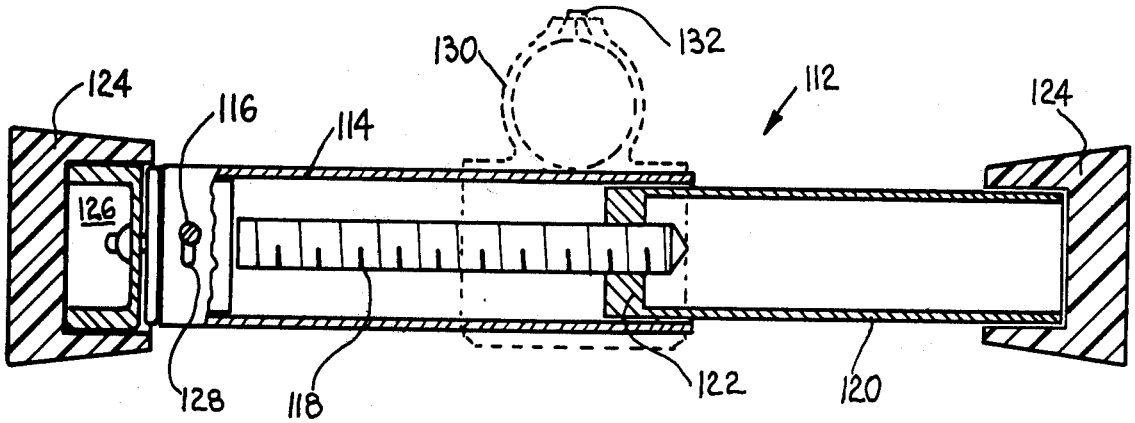
Figure 8:
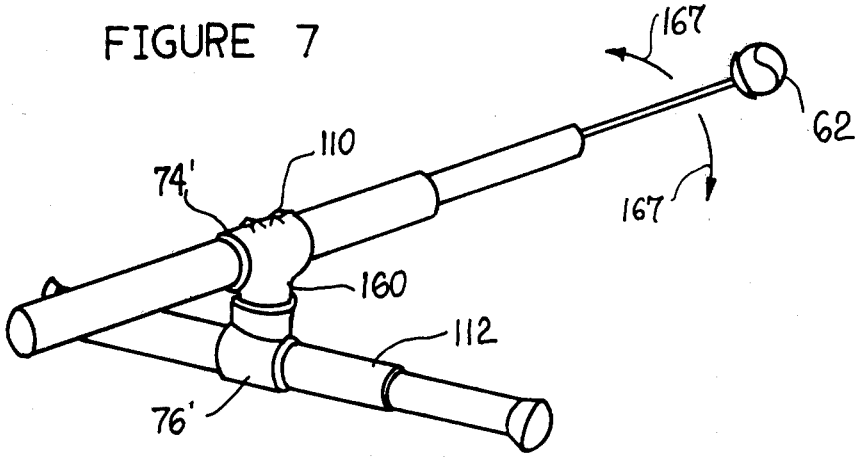

FIG. 5*a* is a detailed view showing one embodiment of means for mounting a tennis ball to one of the telescoping shafts;

FIG. 5*b* is a detailed view of another embodiment of a means for mounting the tennis ball to the telescoping shaft;

FIG. 6 is a detailed view of the telescoping shaft assembly;

FIG. 7 is a detailed plan view of the mounting unit of FIG. 2;

FIG. 8 is an isometric view of still another embodiment of a mount; and

Figure 4:
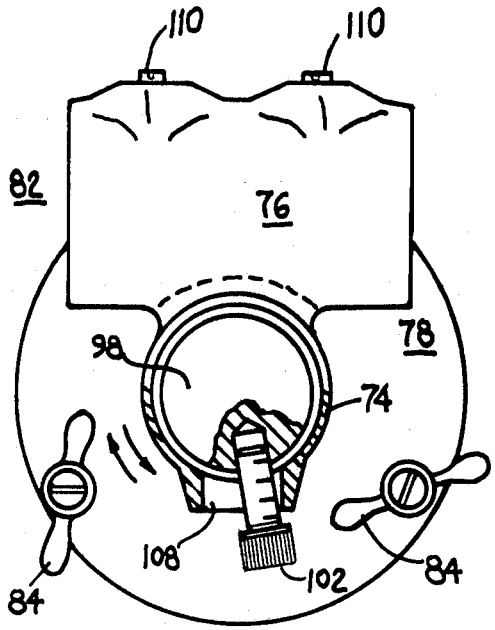
FIG. 4 is a partial detailed view of the mounting unit of FIG. 3 taken along line 4—4 in FIG. 3.
Figure 9:
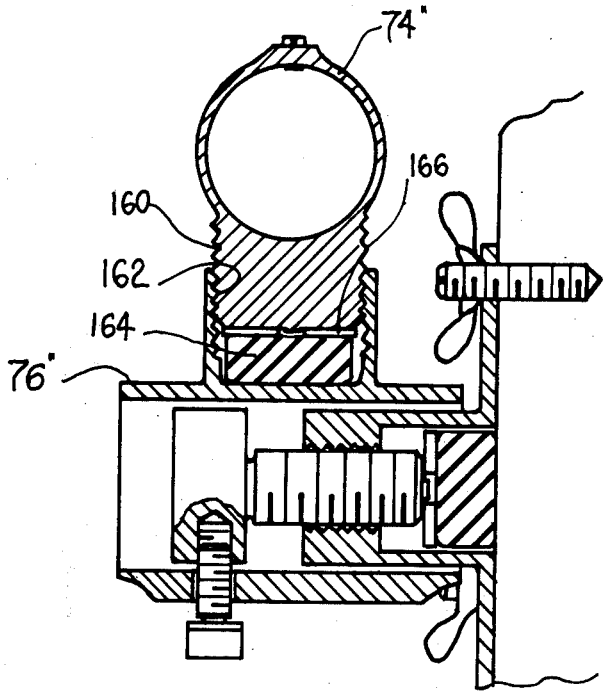

FIG. 9 is a detail view of the mount of FIG. 9 as applied to the support of FIG. 4.

Figure 1:
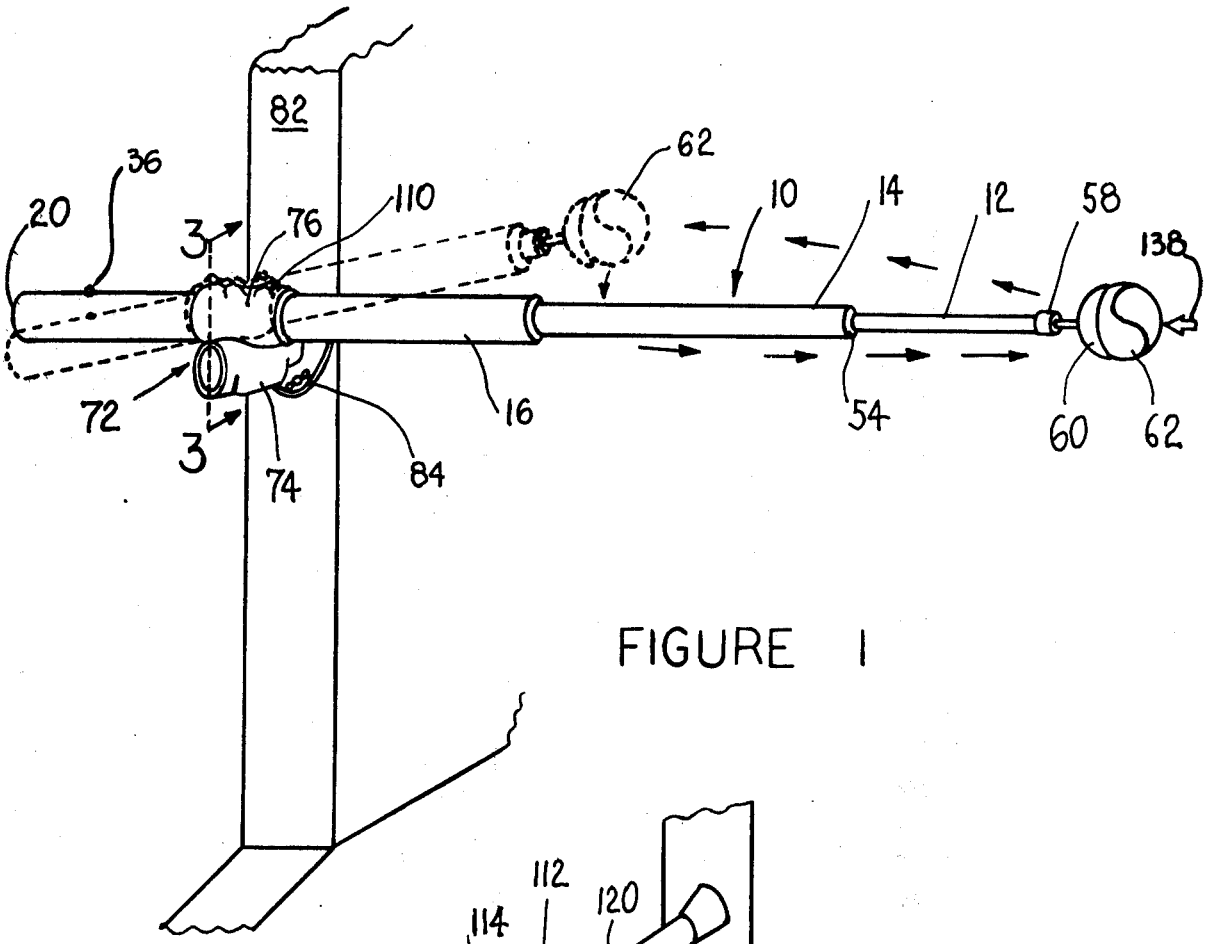
FIG. 1 is an isometric view of the tennis trainer of the instant invention mounted in a door frame and showing one embodiment of a mounting unit.

Referring now to FIG. 1, the numeral 10 denotes a telescoping shaft assembly comprising three shafts denoted by the numerals 12, 14 and 16. Although three shafts are shown, it is to be understood that two or more telescoping shafts can be employed rather than the three chosen for purposes of illustration.

Referring to FIG. 6, shaft 16, which is the largest of the shafts, is provided with a rather large internal bore 18 and is closed at its rear end 20 by a plug or closure 22. Sleeve 24 is placed in he shaft adjacent the plug 22. Rubber plug or bushing 26 is mounted internally of the sleeve 24 and is affixed to the sleeve by conventional means, such as epoxy, or it may simply be press fitted into place. Plug 26 is grooved at 28 to form an extension 30 on which a coil spring 32 is mounted. The other end of the coil spring contacts a slidable seal 34 which is conventionally mounted to the rear portion of shaft 14.

Shaft 14 is smaller in diameter than shaft 16 and telescopes within shaft 16. Positioned along the outer surface of shaft 16 is an opening 36 which vents the interior of shaft 16 to atmosphere for purposes to be described hereinafter.

The rearward portion of shaft 14 is surrounded by a rubber or plastic sleeve 38. For best results, sleeve 38 should occupy between about $\frac{1}{4}$ and $\frac{1}{3}$ of the length of tube 14 to help prevent cocking of tube 14 during its travel in tube 16.

The forward end 40 of shaft 16 is provided with a closure 42, preferably made of metal, having a bore 44 in which shaft 14 slides. The limits of movement of shaft 14 within tube 16 are determined by coil spring 32 and closure 42. The bore 44 in closure 42 is sufficient to permit sliding motion of shaft 14 with respect to shaft 16, but is smaller than the outer diameter of sleeve 38. At the fully extended position of shaft 14 as shown in FIG. 1, sleeve 38 will contact closure 42 to prevent separation of shaft 14 from shaft 16 and thus establish its maximum extended position. Sleeve 38 functions as a shock absorber rather than as a spring to absorb impact energy when it strikes closure 42 during travel of shaft 14 to its fully extended position.

Shaft 12 is slidably mounted within shaft 14. A seal 46 is mounted on the rear portion of sleeve 12 by a conventional means, such as screw and washer assebmly 48.

Surrounding shaft 12 at its rearward portion is a sleeve 52 which may be made of plastic or rubber. A closure 54 is mounted at the forward end of shaft 14 and is provided with a bore 56 in which shaft 12 can slide. Bore 56 is of lesser diameter than the outer diameter of sleeve 52. Thus, closure 54 and sleeve 52 serve as a stop to establish the fully extended position of shaft 12 with respect to shaft 14. Closure 54 is preferably made of metal. Sleeve 52 functions as a shock absorber when it contacts closure 54. However, a coil spring similar in design to sleeve 52 may be used if desired, but the sleeve is preferred.

The drawings illustrate shaft 12 as hollow. A solid shaft may be employed instead. For best results, shaft 12 should be heavier than shaft 14 to permit an efficient transfer of momentum from shaft 12 to shaft 14. Too heavy a shaft will make it difficult to simulate real play conditions.

As shown in FIG. 6, a rod 66 is slidably mounted within shaft 12. Rod 66 is best seen in FIG. 5*a* and comprises a forward portion 67 which is connected to a large diameter rear portion 69, thus forming a shoulder 71 at the junction. A closure or cap 59 is mounted on the end of shaft 12 by conventional means, such as by cooperating screw threads. Closure 59 provides an abutment surface 59' for shoulder 71 to prevent removal of rod 66 from shaft 12. A rubber bumper 63 is mounted on shaft 12 adjacent closure 59 which serves to cushion against shock when the bumper 63 collides with closure 54 in shaft 14 when shaft 12 telescopes into shaft 14.

As shown in FIG. 6, a plurality of coil springs 61 are mounted on rod 66 adjacent closure 59 and facing force plate or cup 60. The force plate or cup 60 is freely mounted on the forward end of rod 66 adjacent the surface of tennis ball 62. Tennis ball 62 is mounted to rod 66 via a conventional butterfly fastener 64 and a conventional nut 68.

FIG. 5*a* illustrates another embodiment of the means for mounting the tennis ball 62 to shaft 66 in which coil springs 61 are eliminated in favor of a bumper, preferably rubber, denoted by the numeral 58'. All other structural parts are the same as illustrated in FIG. 6.

To assemble the rod 66 and tennis ball to shaft 12, one first places bumper 63 on shaft 12. Closure 59 is then placed on rod 66 along with coil springs 61 (FIG. 6 embodiment) or bumper 58' (FIG. 5*a* embodiment). Force plate 60 is then placed on rod 66 along with butterfly fastener 64. The wings of the butterfly fastener 64 are then collapsed and inserted through opening 70 into the tennis ball 62 thus completing the assembly of tennis ball 62 to rod 66. Finally, rod 66, with the tennis ball 62 and the other parts described above attached, is inserted into hollow shaft 12. Closure 59 is then rotated to engage the screw threads on shaft 12, thus completing the assembly of rod 66 to shaft 12.

FIG. 5*b* illustrates still another embodiment of a means for mounting the tennis ball 62. In this particular instruction, shaft 12 is solid and a reduced diameter end section 73 is employed, creating a shoulder 75 against which a washer 77 is mounted. For best results, the washer is integrally united to shaft 12 to prevent its sliding movement between the washer and the shaft.

Rubber bumpers 79 and 58' are mounted on either side of washer 77, bumper 79 serving to absorb contact shock when the shaft telescopes freely into shaft 14. Bumper 58' serves to absorb and transfer contact shock from force plate 60, through washer 77, to shaft 12 thus causing shaft 12 to telescope into shaft 14 when the tennis ball is struck. Bumper 79 and 58' may either be fixedly mounted in place or allowed to slide FIGS. 5*a*, 5*b* and 6 illustrate three types of structures for mounting the tennis ball 62 to shaft 12. These drawing figures are intended to portray only a portion of the range of structures available to the skilled artisan, and are not intended to be limiting.

Figure 3:
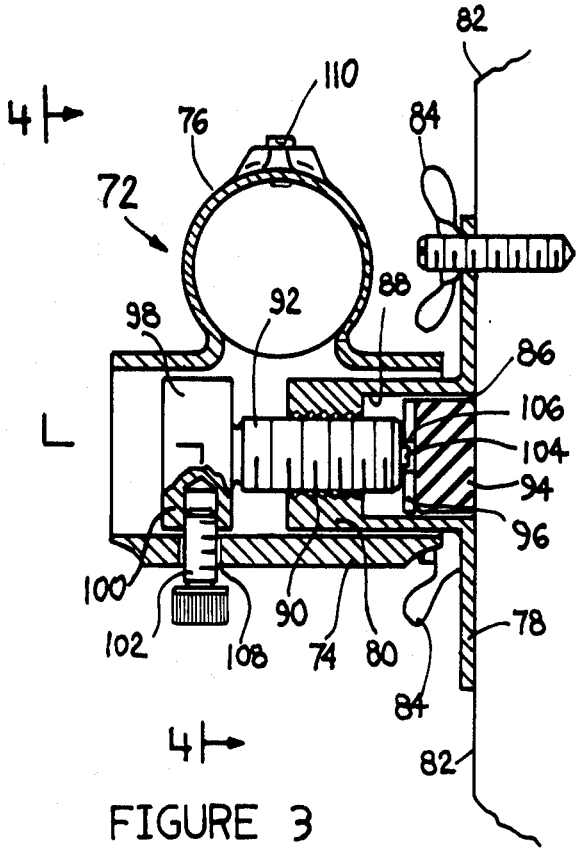
FIG. 3 is a detailed view of the mounting unit of FIG. 1 taken along line 3—3 in FIG. 1.

FIG. 1, 3 and 4 illustrate one embodiment of a mount for securing the telescoping shaft assembly to a support. The mount, denoted generally by the numeral 72, is comprised of a lower collar 74 and an upper collar 76. As shown in FIG. 3, the upper and lower collars are preferably integral with each other. Shaft 16 is preferably mounted in upper collar 76.

Mount 72 is provided with a plate 78 having an extension 80 which stands away from the mounting surface 82, which can be a conventional wall or door frame. Plate 78 is secured to the surface 82 by conventional fastening means, shown herein as wingnuts 84. A chamber 88 is formed in extension 80 and communicates with the surface 82 through an opening 86.

Extension 80 is provided with a threaded bore 90 which accepts a mounting assembly. The mounting assembly comprises a set screw 92, a rubber bumper 94, and a pressure plate 96 inserted between the rubber bumper and the set screw. The other end of the set screw terminates in an enlarged head 98 having a bore 100 therein for accepting an abutment means 102, herein shown as a set screw.

The mount 72 is assembled as follows:

Set screw 92 is threaded into extension 80 until the forward end of the set screw is positioned in chamber 88. At this point, pressure plate 96, which is preferably secured to rubber bumper 94 by conventional means, such as epoxy glue, is placed in chamber 88. The end of set screw 92 is provided with a shoulder or flange 104 adapted to loosely fit into an opening 106 provided in pressure plate 96 to permit screw 92 to rotate with respect to rubber bumper 94. Plate 78 is then secured to surface 82 via wingnuts 84.

Lower collar 74 is then slipped over extension 80 until hole 108 in lower collar 74 aligns with bore 100 in head 98. Abutment member 102 is then inserted into bore 100 to complete the assembly of collar 74 to post 80.

Set screw 92 is tightened by rotating the entire collar assembly until rubber bumper 94 is solidly against surface 82. It is to be noted herein that rubber bumper 94 can be replaced by any conventional means which serves to frictionally engage surface 82.

As illustrated in FIG. 4, the opening 108 is larger than abutment member 102. Collar 74 is free to rotate on extension 80 within the constraints imposed by opening 108 and abutment member 102. For the particular construction illustrated in FIG. 4, the range of movement of collar 74 on extension 80 is about 10°. Although 10° is a preferred range of pivoting motion, any other range desired can be selected by appropriate selection of the size of the opening 108 and the diameter of the abutment member 102.

Upper collar 76 is integral with lower collar 74. Shaft 16 fits inside cllar 76 and is anchored in place therein by conventional set screws 110. The completed mounting is shown in FIG. 1.

An alternative mount is illustrated in FIGS. 2 and 7. The mount shown in FIG. 2, denoted generally by the numeral 112, comprises an extensible bar having an outer sleeve 114 connected via a pin or other fastening means 116 to a screw rod 118. Screw rod 118 is connected to 3 extensible rod 120 through a bore having cooperating screw threads and denoted in the drawing by the numeral 122. Each end of mount 112 is capped by a rubber cap 124 which grips the sides of a door frame, denoted by the numeral 82' in FIG. 2. The assembly is completed by a roller 126 to which screw rod 118 is journaled so that rotation of shaft 114 and screw rod 118 can continue and increase the tightening force even after the rubber cups have functionally engaged the sides of the door frame.

It is desirable to provide for a degree of free rotation of approximately 10° between outer sleeve 114 and screw rod 118. This is provided by slotted opening 128 in the surface of sleeve 114, the extent of the slotted opening determining the extent of free movement of the sleeve 114.

Shaft 16 is mounted in upper collar 130 by set screws 132, as shown in FIG. 2. Lower collar 134 is placed at right angles to upper collar 132 substantially similar to the arrangement in FIG. 3. The two collars are preferably integral and lower collar 134 is slipped onto outer sleeve 114 and tightened by set screws 136.

In operation and with reference to FIG. 1, tennis ball 62 is struck by the racket which moves the ball in the direction of arrow 138. Bumper 58', or coil springs 61, takes the force of the stroke through pressure plate 60 and collapses shaft 12 into shaft 14. When closure 54 is contacted, shaft 14 is then collapsed or telescoped into shaft 16.

As shown in FIG. 1, the trajectory of tennis ball 62 is somewhat hyperbolic, rising above the level of the mount as the shafts telescope and falling back during return movement of the shafts. This occurs due to the slotted opening 108 (FIG. 4) or 128 (FIG. 7) which allows the entire shaft assembly to pivot on extension 80 to the point where abutment member 102 or 116 contacts one of the walls of opening 108 or 128. One can readily appreciate that the rise of the tennis ball 62 as it leaves the racket simulates real play conditions in which the tennis ball would tend to rise during its flight to and over the net.

The movement of shaft 14 inwardly compresses coil spring 32, thereby storing energy for returning shaft 14 towards its fully extended position. When this occurs, shaft 14 begins to move forward with shaft 12. If the tennis ball 62 has been struck properly and hard enough, the energy stored in coil spring 32 will be sufficient to return shaft 14 to the point where sleeve 38 contacts closure member 42. The sudden stop of shaft 14 does not affect shaft 12 which continues until sleeve 52 contacts closure 54. At this point, the assembly is fully extended and ready to receive the next racket stroke.

An opening 36 is provided in the wall of shaft 16 when shaft 14 is in its fully extended position, opening 36 is to the left of seal 34 as viewed in FIG. 6, and serves to vent the interior of shaft 16 located to the left of the seal to atmosphere. When the seal 34 passes opening 36 as it telescopes into shaft 16, the interior to the left of the seal no longer vents to atmosphere and pressure builds up as shaft 14 continues its telescoping action, thus slowing the movement of shaft 14. Air will slowly leak past seal 14 to the atmosphere through opening 36 and pressure will tend to equalize. When shaft 14 begins its return movement, a vacuum will be drawn in the interior of shaft 16 to the left of the seal 34, thus slowing return movement until seal 14 slides by opening 36. This highly desirable feature slows the movement of the telescoping shafts sufficiently to permit the user to get ready to again strike the tennis ball when it returns. To control the degree of slowdown, a conventional adjustable valve 37 may be placed in opening 37 as shown. Opening 36 functions to slow the initial return movement of the shafts to more fully simulate real play conditions.

The operation of the embodiment shown in FIG. 2 is essentially the same as the operation of the preceding embodiment, the only difference being in the use of the mount shown in FIG. 7. Since outer sleeve 114 is able to pivot within the confines of slotted hole 128 in essentially the same manner as described for the mount shown in FIG. 3, tennis ball 62 will follow a similar trajectory.

The mount depicted in FIGS 1, 3 and 4, and the mount depicted in FIGS 2 and 7, rely on frictional force exerted by rubber bumper 94 (FIGS. 1, 3 and 4) or rubber cups 124 (FIGS. 2 and 7) for securing the mounts against rotation beyond the ten degrees provided for through slots 108 and 128, respectively. It has been found that when fully tightened in place, the mount can be moved to position the shaft assembly at an angle to the horizontal of up to about 35° without destroying or substantially diminishing the ability of the rubber bumper 94 or cups 124 to prevent further rotation of the shafts during use. Thus, the shafts may be set for use at different heights and angles to simulate low arriving tennis balls or high arriving tennis balls.

Not only does the tennis trainer shown and described herein simulate actual play conditions, it also reacts to an improper stroke. For instance, if the tennis ball is hit off center, the force transfer through force plate 60 will be inefficient and in many instances insufficient to completely telescope the shafts. If the ball should be hit in a horizontal plane other than directly along the axis of the shafts, the force transfer through pressure plate 60 will again tend to be insufficient to transfer all of the force directly along the shafts. If, however, the tennis ball is hit sufficiently hard to in fact telescope shafts 12 and 14 into shaft 16, it is unlikely that a sufficient amount of force will have been exerted on coil spring 32 to cause a complete return of the shafts to their original position. Lastly, an off center hit will tend to set up vibration in the shafts which will inform the user that the stroke was not a good one.

Mis-hitting the tennis ball in the horizontal plane will not only set up vibration, but may very well damage the shafts. To prevent this, the collar assembly may be split into separate upper and lower collars denoted by the numerals 74' and 76' in FIGS. 8 and 9.

FIG. 8 illustrates the collar assembly employed with mount 112 (FIG. 2). Upper collar 74' terminates in a threaded section 160 which cooperates with threaded bore 162 in lower collar 76'. As portrayed in FIG. 9, lower collar 76" contains a rubber block 164 and a metallic disc or plate 166. Rubber block 164 is pressed against the surface of support 112 when the upper collar 74" is screwed down into the lower collar. The frictional force exerted by the rubber block against the support is normally sufficient to prevent rotational movement between the upper and lower collars. However, should the tennis ball 62 be struck such that considerable force is applied in the direction of arrows 167, the frictional force preventing rotation of the upper collar will be exceeded and the shafts allowed to pivot in the horizontal plane, thus preventing damage to the shafts.

FIG. 9 illustrates the use of the split collar assembly with the mount 72 depicted in FIGS. 1, 3 and 4. Lower collar 76" does not open into upper collar 74" as depicted in FIG. 3. Rather, the wall of collar 76" serves as an abutment surface for rubber block 164 and is on the surface against which pressure is applied when upper collar 74" is fastened down to compress rubber block 164. It can be readily appreciated that horizontal movement will be permitted if the force applied to the tennis ball in the direction of the arrows 166 exceeds the frictional force between the rubber block and the surface of collar 76".

Many modifications may be made in and to the embodiments described herein by those of ordinary skill in the art. It is intended to cover all such modifications which fall within the spirit and scope of the invention as described in the claims appended hereto.

What I claim is:

1. A tennis trainer comprising a telescoping shaft assembly having a plurality of shafts slidable with respect to each other, a tennis ball and means for mounting said tennis ball to a first one of said shafts, support means, means for mounting a second one of said shafts to said support means, said first shaft being relatively slidable with respect to said second shaft, at least one intermediate shaft fitting within said second shaft and over said first shaft and being relatively slidable with respect to both said first and second shafts, first resilient means located within said second shaft for stopping te sliding movement of the said first shaft and said intermediate shaft and for imparting return movement to said first shaft and said intermediate shaft.

2. The tennis trainer according to claim 1 wherein said second shaft is nonslidably mounted to said support.

3. The tennis trainer according to claim 1 wherein said tennis ball is a pressureless hollow interior ball; an opening in said tennis ball, and a fastener having collapsible and expandable arms adapted to be collapsed and slipped through said opening into the interior of said pressureless tennis ball, said fastener expanding inside said pressureless tennis ball to mount said pressureless tennis ball to said first shaft.

4. The tennis trainer according to claim 3 further comprising a force plate mounted on said first shaft and adjacent said tennis ball for transferring the impact force of the tennis racket to said first shaft.

5. The tennis trainer according to claim 1 wherein the said first shaft is heavier than said at least one intermediate shaft.

6. The tennis trainer according to claim 1 wherein said at least one intermediate shaft is provided with internally mounted means for receiving the force of said first shaft and said at least one intermediate shaft when said ball is struck.

7. The tennis trainer according to claim 6 wherein the force receiving means is a metallic closure.

8. The tennis trainer according to claim 1 further comprising means for stopping return movement of each of said first and said at least one intermediate shafts as each of said first and at least one intermediate shaft reaches full extension.

9. The tennis trainer according to claim 1 further comprising a slidable seal between said second shaft and said at least one intermediate shaft, said slidable seal forming a variable volume chamber comprising said seal, one end of said second shaft and the portion of the second shaft located between said one end and said seal, an opening in said second shaft located a selected distance from the location of said seal when said intermediate shaft is fully telescoped in said second shaft to control the speed at which said at least one intermediate shaft telescope and return to the fully extended position.

10. The tennis trainer according to claim 1 wherein said support means comprises a first collar fixedly mounted to said second shaft, an extensible bar assembly comprising a rotatable sleeve and an extensible rod mounted in said rotatable sleeve, means rotatably coupling said sleeve to said rod, rotation of said sleeve in a first direction extending said rod to permit mounting said assembly in a door frame, rotation in the direction opposite to said first direction reversing the direction of movement of said rod permitting removal of said assembly for said door frame.

11. The tennis trainer according to claim 10 further comprising cups mounted on the rod and on the sleeve for engaging the door frame upon extension of said rod.

12. The tennis trainer according to claim 10 wherein said first collar comprises an opening, a plug in said opening in contact with said extensible bar assembly, said plug having a substantially planar face thereon, a second collar, said second shaft being mounted in said second collar, said second collar having an extension secured in said opening and pushing said plug against said extensible bar assembly to permit movement of the shafts in response to applied force in a plane parallel to the face of the plug in excess of the friction force between said plug and said extensible bar assembly.

13. The tennis trainer according to claim 1 wherein said support means comprises a flange having an extension thereon; means for securing said flange to a support, a collar assembly comprising a first collar surrounding said extension and means for locating said collar assembly on said extension, a second collar mounted on said first collar, said second shaft being mounted in said second collar, and means for permitting said collar assembly to rotate a selected amount on said extension.

14. The tennis trainer according to claim 13 wherein said means for permitting said first collar to rotate on said extension comprises an opening in said first collar, said means for locating said first collar on said extension comprising an abutment member, said abutment member being releasably secured to said extension, said abutment member passing through said opening and being smaller than said opening whereby the first collar is located on said extension, the limits of rotation of said collar being fixed by the difference in size of said opening and said abutment member.

15. The tennis trainer according to claim 14 wherein said plate has an opening therein, a chamber in said extension communicating with said opening, said extension further comprising screw means in said extension, said screw means having one end positioned in said chamber, a rubber plug on said one end adapted to contact said support, said screw means having a head located adjacent the opening in said first collar, said abutment member being releasably mountable to said head.

16. The tennis trainer according to claim 12 wherein said first collar comprises a wall having an upstanding tube mounted thereon, a rubber plug in said tube, said plug having a substantially planar face thereon, said second collar having an extension secured in said upstanding tube and pressing said plug against said wall to permit movement of the shafts in response to applied force in a plane parallel to the face of the plug in excess of the friction force between said plug and said extension.

17. A tennis trainer comprising a telescoping shaft assembly having first, second and third shafts, said first shaft telescoping into said second shaft and said second shaft telescoping into said third shaft, a tennis ball mounted on said first shaft, resilient means mounted internally of said third shaft for receiving the force of said first and second shafts when the tennis ball is struck and for returning the first and second shafts towards their fully extended positions, and means for supporting said third shaft.

18. The tennis trainer according to claim 17 wherein said second shaft is lighter in weight than said first shaft.

19. The tennis trainer according to claim 17 further comprising closure means on said second and third shafts for absorbing the force of said first and second shafts respectively when said first and second shafts reach full extension during their return movement.

20. A tennis trainer kit comprising a. a telescoping shaft assembly having first, second and third shafts, said first shaft having a tennis ball mounted thereon, said first shaft telescoping into said second shaft and said second shaft telescoping into said third shaft and means in said third shaft for receiving the force of said first and second shafts when the tennis ball is struck and for returning the first and second shafts towards their fully extended positions;

b. a collar assembly having first and second collars fixedly connected to each other, said first collar being mountable on said third shaft, and means for securing said first collar to said third shaft;

c. means for mounting said telescoping shaft assembly to a fixed surface;

21. A tennis trainer kit comprising a. a telescoping shaft assembly having first, second and third shafts, said first shaft having a tennis ball mounted thereon, said first shaft telescoping into said second shaft and said second shaft telescoping into said third shaft and means in said third shaft for receiving the force of said first and second shafts when the tennis ball is struck and for returning the first and second shafts towards their fully extended positions;

b. a collar assembly having first and second collars connected to each other, said first collar being mountable on said third shaft, said second collar having a hole in its wall, and means for securing said first collar to said third shaft;

c. a support plate having an opening therein, an extension fixedly mounted on said support plate having a chamber therein in communication with said opening and a screw hole in communication with said chamber, said second collar fitting over and rotating said extension said second collar having an opening therein;

d. screw means being mountable in said screw hole, and support surface engaging means on said screw means for positioning in said chamber, and e. abutment means being mountable in the wall of the hole in said second collar for securing to said extension, said abutment means being smaller than the opening in said collar to permit a selected amount of rotation of said second collar with respect to said extension upon assembly.

* * * * *